US007699006B2

(12) United States Patent
Miller et al.

(10) Patent No.: US 7,699,006 B2
(45) **Date of Patent: *Apr. 20, 2010**

(54) CARRIER AND A MAGNETIC LEVITATION RAILWAY PROVIDED WITH SAID DECK

(75) Inventors: Luitpold Miller, Ottobrunn (DE); Qinghua Zheng, Taufkirchen (DE); Markus Bauer, Freisig (DE); Werner Hufenbach, Dresden (DE); Klaus Kunze, Dresden (DE)

(73) Assignee: ThyssenKrupp Transrapid GmbH, Kassel (DE)

( * ) Notice: Subject to any disclaimer, the term of this patent is extended or adjusted under 35 U.S.C. 154(b) by 604 days.

This patent is subject to a terminal disclaimer.

(21) Appl. No.: 10/550,282

(22) PCT Filed: Mar. 18, 2004

(86) PCT No.: PCT/DE2004/000564

§ 371 (c)(1),
(2), (4) Date: Oct. 16, 2006

(87) PCT Pub. No.: WO2004/085744

PCT Pub. Date: Oct. 7, 2004

(65) Prior Publication Data

US 2007/0034106 A1 Feb. 15, 2007

(30) Foreign Application Priority Data

Mar. 25, 2003 (DE) ..... 103 14 068

(51) Int. Cl.
*B60L 13/04* (2006.01)

(52) U.S. Cl. ..... 104/281; 104/259

(58) Field of Classification Search ..... 104/124, 104/281, 259, 134, 135, 260
See application file for complete search history.

(56) References Cited

U.S. PATENT DOCUMENTS

| | | | | | |
|---|---|---|---|---|---|
| 3,797,402 | A | * | 3/1974 | Karch | 104/130.02 |
| 3,937,148 | A | * | 2/1976 | Simpson | 104/283 |
| 5,027,713 | A | * | 7/1991 | Kindmann et al. | 104/124 |
| 5,140,208 | A | * | 8/1992 | Tozoni | 310/90.5 |
| 5,267,091 | A | * | 11/1993 | Chen | 359/872 |
| 5,511,488 | A | * | 4/1996 | Powell et al. | 104/282 |
| 5,649,489 | A | * | 7/1997 | Powell et al. | 104/282 |

(Continued)

FOREIGN PATENT DOCUMENTS

DE 2 021 834 3/1972

(Continued)

OTHER PUBLICATIONS

Zev-Glas. Ann 105, 1981, No. 7/8 Jul./Aug., pp. 205-215.

(Continued)

*Primary Examiner*—S. Joseph Morano
*Assistant Examiner*—Jason C Smith
(74) *Attorney, Agent, or Firm*—Michael J. Striker

(57) ABSTRACT

The invention relates to a carrier (11) and a magnetic levitation railway provided with said carrier. The inventive carrier (11) comprises a sliding surface (14) and the sliding skates of a vehicle travelling along said magnetic levitation railway. According to said invention, the sliding surface (14) is provided with a coating (15, 16, 17) which comprises at least on the external area thereof an additional material which is compatible with the material for skates and reduces friction and ware.

22 Claims, 2 Drawing Sheets

U.S. PATENT DOCUMENTS

| | | | | |
|---|---|---|---|---|
| 6,085,663 | A * | 7/2000 | Powell et al. | 104/281 |
| 6,129,025 | A * | 10/2000 | Minakami et al. | 104/88.01 |
| 6,450,103 | B2 * | 9/2002 | Svensson | 104/120 |
| 6,820,946 | B2 * | 11/2004 | Salamat et al. | 303/122.09 |
| 6,916,075 | B2 * | 7/2005 | Salamat et al. | 303/112 |
| 6,951,372 | B2 * | 10/2005 | Salamat et al. | 303/112 |
| 7,198,817 | B2 * | 4/2007 | Takahashi et al. | 427/127 |
| 7,387,349 | B2 * | 6/2008 | Salamat et al. | 303/155 |
| 2003/0089581 | A1 * | 5/2003 | Thompson et al. | 198/619 |
| 2003/0104246 | A1 * | 6/2003 | Watanabe et al. | 428/692 |
| 2004/0096575 | A1 * | 5/2004 | Takahashi et al. | 427/128 |
| 2004/0144960 | A1 * | 7/2004 | Arai et al. | 252/500 |
| 2007/0034106 | A1 * | 2/2007 | Miller et al. | 104/286 |

FOREIGN PATENT DOCUMENTS

| | | |
|---|---|---|
| DE | 29 00 053 | 7/1980 |
| EP | 0 381 136 B1 | 9/1992 |

OTHER PUBLICATIONS

"Magnet Transrapid, Die Neue Dimension Des . . ." Hestra Verlag Darmstadt, 1989, pp. 21-23.

"Neue Verkehrstechnologien" Henschel Magnetfahrtechnik, Jun. 1986.

"Der Transrapid, Wir Stellen Die Weichen Fuer China" Thyssenkrupp Stahlbau GMBH, Issue Feb. 2002.

* cited by examiner

CARRIER AND A MAGNETIC LEVITATION RAILWAY PROVIDED WITH SAID DECK

BACKGROUND OF THE INVENTION

The invention relates to a guideway carrier with a sliding surface for magnetic levitation railways, the vehicles of which are at least provided with one sliding skate each for setting-down on said sliding surface, and a magnetic levitation railway fabricated therewith.

The guideways of magnetic levitation railways are composed of guideway carriers that are also provided with so-called sliding surfaces, apart from the driving means frequently configured as stator packs of long-stator linear motors and apart from lateral guidance surfaces destined for tracking. In the majority of applications, these sliding surfaces are installed on the upper surface of guideway carriers and both in normal stopping and in cases of emergency they serve for setting-down the vehicles by the aid of sliding skates mounted at their undersides. The designations "sliding" surface and "sliding" skate are meant to express that the sliding skates can be set-down on the sliding surfaces not only during a standstill but also during the ride of vehicles and can be moved on them in sliding mode until the vehicle comes to standstill. For example, such a situation may occur in case of a failure of a support magnet, because in this case a pertinent section of the vehicle and/or of its levitation frame sinks down so far that the vehicle sets-down at least with one sliding skate on the sliding surface. As a result hereof, and in view of the high speeds achievable with magnetically levitated vehicles reaching 400 km/h and more, substantial friction energies are induced that entail high temperatures and intensive wear and tear in the area of sliding partners concerned.

To date little attention has been paid to friction conditions occurring in case of emergency setting-downs. The sliding properties rather resulted more or less by mere accident from the materials used for sliding skates and sliding surfaces. It was taken for granted that the sliding surfaces, like the guideway girders, were made of steel or concrete, and that sliding skates would have to be made of a material that compared with steel or concrete is distinguished by a high abrasion resistance. It is also known as prior art in this context to configure the sliding surfaces at sliding ledges made of steel and to provide them with corrosion protection coatings made of zinc dust and micaceous iron ore based on epoxy resin and/or polyurethane.

In practical operation of magnetic levitation railways of the type described hereunder, it became evident that the sliding properties obtained in this manner are insufficient for various reasons. It may particularly be desired not to perform a repair or maintenance of defective vehicles immediately or anywhere alongside the guideway whenever a defect occurs but to let defective vehicles ride on, if possible, until they reach a shop suitable for performing such repair and maintenance work. However, in these cases the high friction forces occurring on a failure of support magnets between prior art sliding skates and sliding surfaces would cause high mechanical strains and temperatures so that safely reaching the nearest repair shop without premature complete wear of sliding skates and/or sliding surfaces could only be assured by locating such repair shops alongside the guideway at comparatively short distance. If the distance between such repair shops is too large, many defects affecting the vehicles would also cause damage to the sliding surfaces and, therefore, call for a repair to affected sliding surfaces and even to the complete guideway, which would entail substantial cost of operation and which must be avoided.

SUMMARY OF THE INVENTION

Now, therefore, it is the task of the invention to configure the sliding surfaces of the guideway carriers designated hereinabove in such a manner that the sliding properties of the sliding surface/sliding skate couple are improved, thus allowing for larger distances between maintenance and repair shops to be erected alongside the guideway.

With the sliding surfaces according to the invention being provided with a coating that contains an additional material which is compatible with the sliding skate material and reduces friction and wear, the sliding properties can be so optimized that a magnetically levitated vehicle on failure of a support magnet or the like and/or when at least one sliding skate sets-down on the sliding surface can still cover a comparatively long way without this leading to a situation that might be critical for the guideway and/or vehicle. The enhancement of distances between repair shops to be provided alongside the guideway notably reduces the cost of capital investment and operation. The lower wear of sliding surfaces caused in case of an emergency setting-down moreover yields the advantage of longer maintenance intervals.

BRIEF DESCRIPTION OF THE DRAWINGS

The invention is hereinafter explained in more detail based upon attached drawings of embodiments given as an example, wherein.

DETAILED DESCRIPTION OF THE PREFERRED EMBODIMENT

Figure 1:
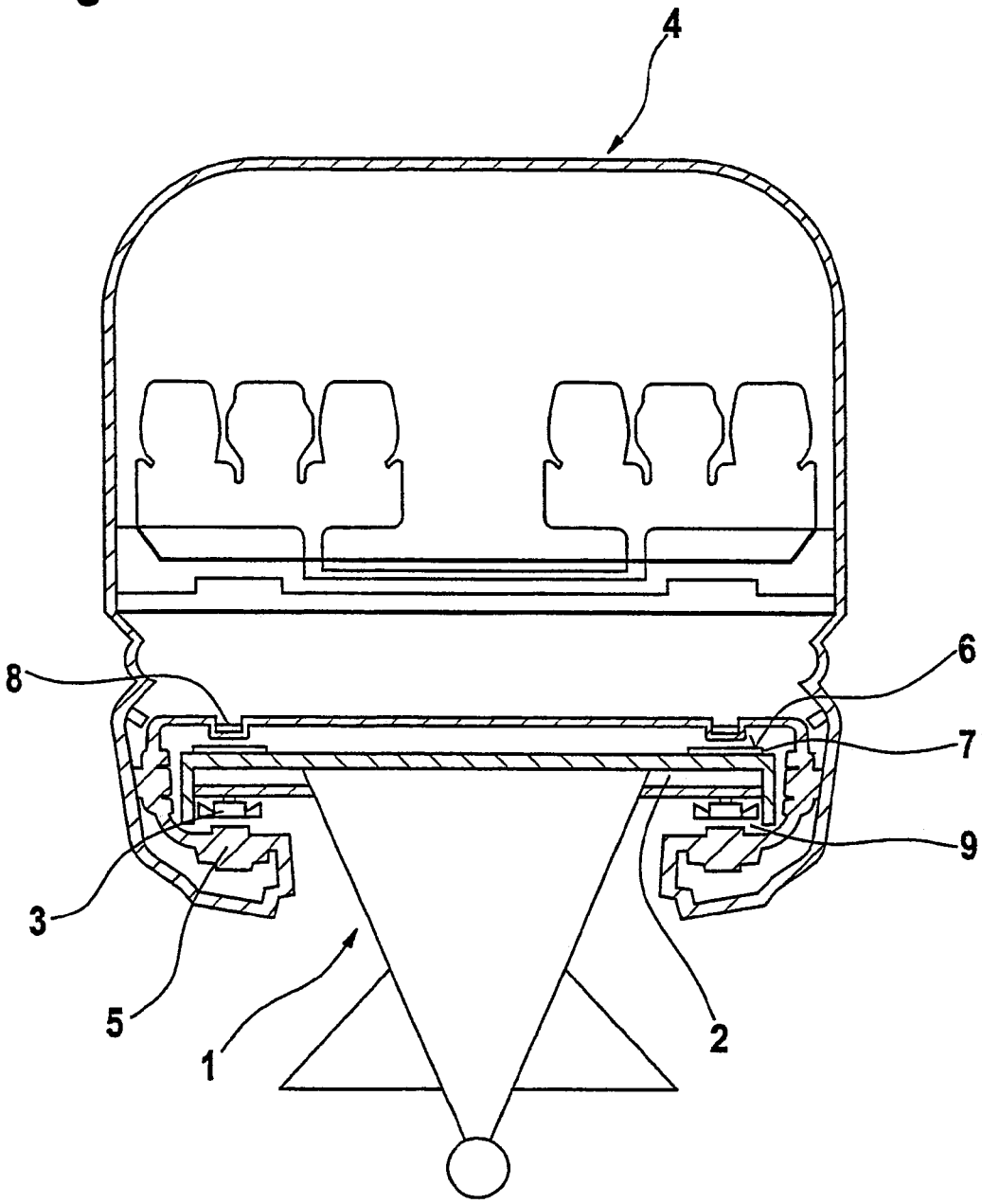
FIG. 1 shows a schematic cross-section through a usual magnetic levitation railway with a guideway carrier and a vehicle.

FIG. 1 schematically shows a cross-section through a magnetic levitation railway with a drive in form of a long-stator linear motor. The magnetic levitation railway is comprised of a plurality of guideway carriers 1 that in the direction of a predefined railway line are arranged one behind the other and which carry stator packs provided with windings and mounted at the undersides of guideway plates 2. Alongside said guideway carriers 1, the vehicles 3 can ride with support magnets 5 that stand opposite to the undersides of stator packs 2 and which simultaneously provide the exciter field for the long-stator linear motor.

At the upper sides of guideway plates 2, sliding surfaces 6 extending in the direction of travel are provided, which for example are configured as the surfaces of special sliding ledges 7 fastened to guideway plates 2. The sliding surfaces 6 act together with the sliding skates 8 fastened to the undersides of vehicles 4, said sliding skates being supported on sliding surfaces 6 in case of a standstill of vehicles 4, thus creating a comparatively large gap 9 between stator packs 3 and support magnets 5. To initiate a ride, support magnets 5 are activated at first in order to lift the sliding skates 8 from the sliding surfaces 6 and to adjust the magnitude of said gap 9, for example to 10 mm, in the status of levitation thus established. Afterwards, said vehicle 4 is set to move.

Magnetic levitation railways of this type are widely known to an expert skilled in the art (e.g. "Neue Verkehrstechnologien", Henschel Magnetfahrtechnik 6/86).

Figure 2:
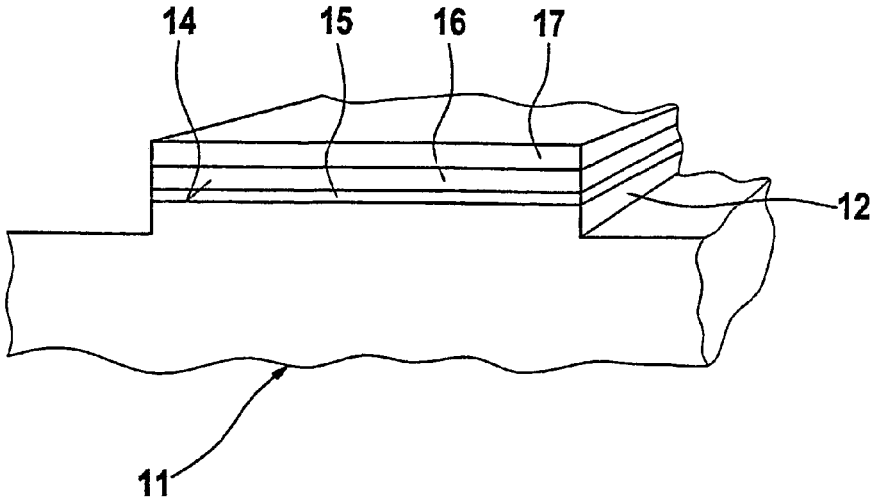
FIG. 2 shows a schematic, perspective partial view of a guideway carrier made of concrete according to the invention, wherein a sliding surface, also made of concrete, is provided with a coating shown exaggerative thick.

FIG. 2 indicatively shows a guideway carrier 11 made of concrete which at its upper side is provided with a thus established one-partite elevation and/or ledge 12 that at is upper side has a sliding surface 14 for the sliding skates 8 of the magnetically levitated vehicle 4 according to FIG. 1. Concrete-based guideway carriers 11 of this type are known, for example, from printed publications ZEV-Glas.Ann 105, 1989, S. 205-215 or "Magnetbahn Transrapid, die neue Dimension des Reisens", Hertra Verlag Darmstadt 1989, S. 21-23 which by reference are hereby made an object of the present disclosure.

While said ledges 12 like guideway girders 11 are hitherto made of concrete, the sliding surfaces 14 according to the invention are provided with a coating that contains three layers 15, 16, and 17 arranged one above the other. Accordingly, the inner layer 15 is immediately applied on said sliding surface 14, while layer 16 is configured as intermediate layer and layer 17 established to serve as outer layer so that with a guideway carrier 11 according to FIG. 2 it is actually the upper surface of said outer layer 17 that would have to be designated as sliding surface, because it is only this layer that normally comes in contact with the sliding skates 8 according to FIG. 1. However, within the framework of the present patent application, the surface 14 of ledge 12 is preferably designated as the actual sliding surface, while the film composed of three layers 15 to 17 is designated as coating for sliding surface 14.

With the example of an embodiment according to FIG. 2, it is envisaged according to the invention to provide the coating at least in an outer area with an additional material that is compatible to the material of sliding skates 8 and reduces friction and wear. In view of most of the sliding skate materials used to date, this additional material is preferably made of graphite or polytetrafluorethylene and is admixed at least to the outer layer 17. Conversely, the inner layer 15 mainly serves as primer and/or wash primer. Finally, the intermediate layer 16 located on the inner layer 15 and under the outer layer 17 serves the function of an adaptor layer and is intended to ensure optimum bonding between the lower layer 15 and the outer layer 17.

The inner layer 15 is preferably made of an epoxy resin system compatible to the concrete surface and/or sliding surface 14. The middle layer 16, too, is preferably made of an epoxy resin, which is also advantageously modified with an additional material that reduces friction and wear, e.g. graphite or polytetrafluorethylene. Preferably used for the outer layer 17, however, is a polyurethane resin serving as matrix material, which the tribologically active additional material graphite, polytetrafluorethylene or the like is admixed to. Moreover, thus yielding a special advantage, a filling substance, e.g. chalk, is admixed to the matrix of the outer layer 17 to reduce heat absorbing capability.

Figure 3:
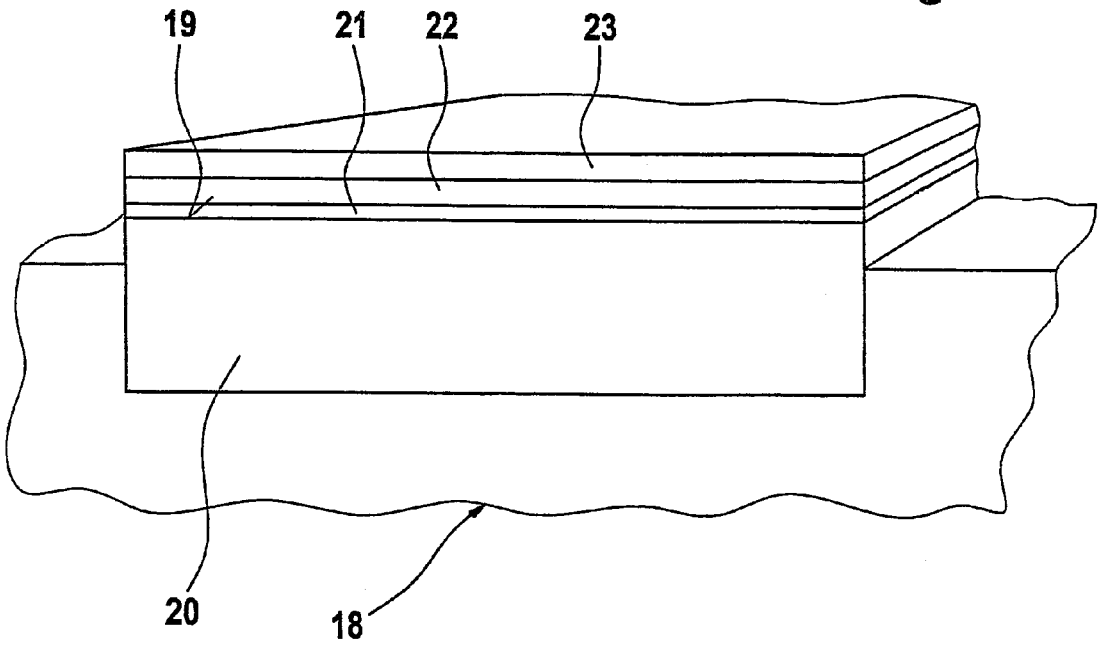
FIG. 3 shows a partial view similar to FIG. 2 of a guideway carrier made of concrete according to the invention, which a sliding ledge made of steel is inserted into and which is provided with a coating shown exaggerative thick.

The approach pursued in the example of an embodiment according to FIG. 3 is the same; it is a guideway built in composite structure and composed of a plurality of guideway carriers 18 arranged one behind the other and made of concrete, into the upper surfaces of which sliding ledges 20 made of steel and provided with sliding surfaces 19 are laid (e.g. EP-B1-0 381 136). As shown in this example of an embodiment, the sliding surfaces 19 project somewhat beyond the surface of the remaining guideway carrier 18 and are provided in prior art manner with a coating serving for anti-corrosion protection, which for example is composed of a first inner layer 21 made of epoxy-based zinc dust, a middle layer 22 lying on it and made of epoxy-resin based micaceous iron ore, and a third outer layer 23 made of polyurethane resin-based micaceous iron ore. A succession of layers of this type is described, for example, in the publication "Der Transrapid, wir stellen die Weichen für China" edited by ThyssenKrupp Stahlbau GmbH, issue February 2002 by the example of a bending turnout made of steel. Therefore, to simplify representation, this publication is by reference made an object of the present disclosure.

According to the invention, a coating of this type serving for anti-rust and corrosion protection is basically maintained, but as shown in the example of an embodiment according to FIG. 2, an additional material, e.g. graphite or polytetrafluorethylene, which is compatible to the material of sliding skates 8 and which reduces friction and wear, is applied, at least in an outer area. For this purpose, the inner layer 21 according to the invention is established from an anti-rust epoxy resin-based wash primer, while the second or middle layer 22 is made of an epoxy resin matrix serving as an adaptor layer, and the outer layer 23, for example, is made of a film modified with graphite or polytetrafluorethylene based on polyurethane resin, with it being particularly advantageous to modify the middle adapter layer and/or layer 22, too, with an additional material like graphite or polytetrafluorethylene that reduces friction and wear.

The polymeric resin systems as described hereinabove preferably constitute commercial well-adapted systems, which the relevant producer additionally provides with a tribologically active component. All layers are preferably applied by a combined spraying or rolling process onto said sliding surfaces 14 and 19, respectively.

Two preferred examples of embodiments are indicated hereinafter, each of which optimally adapted to a sliding skate material made of C—CSiC. It is a carbon C—C reinforced with carbon fibers that is partly caused to react with silicon so that silicon carbide (SiC) is partly formed that affords the required hardness to the carbon. The finished sliding skate material, therefore, can be designated as a carbon ceramics reinforced with carbon fibers and enriched with SiC.

EXAMPLE 1

Proceeding from the example of an embodiment according to FIG. 2, the following composition of layers is currently considered the best:

1. Layer 15 is made of a low-molecular epoxy paint hardened with aromatic amines, this being a low-viscous product with good penetration properties. The material is applied by spraying. The film thickness of layer 15 amounts to 250 μm.

2. Layer 16 is made of a polyamide-adduct-hardened epoxy paint prepared from two components with good wetting properties and low impermeability to water. Before applied on layer 15, the epoxy paint is mixed with approx. 20 percent by mass and/or weight (hereinafter briefly termed % by wt.) of graphite. The finished mix is applied by spraying onto layer 15 so as to make the dried-out layer 16 hard and abrasion-resistant and to give it a thickness of approx. 250 μm.

3. Layer 17 is established with a two-component polyurethane-acrylic finish paint, which prior to its application onto layer 16 is mixed with approx. 45% by wt. of graphite. The application is done by rolling, possibly by additional use of a spatula. Layer 17 achieves a thickness of approx. 300 μm.

The finished coating has a coating of 0.8 mm and excellent sliding properties, particularly if sliding skates 8 made of the a.m. carbon fiber reinforced ceramics based on C—CSiC are used.

Implemented for example 1 was a system from the company Hempel (D-25421 Pinneberg), applying: the product Hempadur Sealer 05970 with hardener 95950 for layer 15, product Hempadur 45143/4514A with hardener 97430 for layer 2, and product Hempel's 555DE with hardener 95370 for layer 17.

EXAMPLE 2

Proceeding from the example of an embodiment according to FIG. 3, the following composition of layers is currently considered the best:

1. Applied by spraying as layer 21 onto sliding surface 19 is a two-component polyamide hardened zinc dust paint. The minimum film thickness amounts to 120 μm.
2. Layer 22 is established with a two-component polyamide-hardened epoxy paint pigmented with micaceous iron ore and becoming hard and very resistant to abrasion when finished. The film thickness amounts to 250 μm. Before applied by rolling, the epoxy paint is modified with 15% by wt. of PTFE-fine powder.
3. Layer 23 is established with a two-component polyurethane-acrylic finish paint by analogy to layer 17 of example 1, but with PTFE instead of graphite, with the admixture of PTFE-fine powder amounting to 35% by wt. The film thickness of layer 23 is rated with approx. 350 μm.

The finished coating has a thickness of 0.72 mm and excellent sliding properties, particularly if sliding skates 8 made of the a.m. carbon fiber reinforced ceramics based on C—CSiC are used.

Implemented for example 2 was a system from the company Hempel (D-25421 Pinneberg), applying the product Hempel's 160DE with hardener 95360 for layer 21, product Hempel's 552DE with hardener 95360 for layer 22, and product Hempel's 555DE with hardener 95370 for layer 23.

Surprisingly obtained by way of examples 1 and 2 is the advantage that the sliding friction coefficient of the tribological sliding surface/sliding skate couple is drastically reduced and that the couple's wear resistance rises by up to ten-fold. Moreover, an excellent adhesive strength of the coating in total is achieved.

The invention is not confined to the examples of embodiments as described hereinabove that can be modified in a plurality of ways. This is particularly valid with regard to the structure of guideway carriers existing in a given case, which apart from the concrete and/or composite structure type as described before may also be a guideway carrier entirely made of steel. Moreover, the term "guideway, carrier" as used within the framework of the invention covers all structures suitable for establishment of guideways for magnetically levitated vehicles of the type described hereinabove (carrier, plate and modular structures and the like), irrespective of whether the sliding surfaces 14, 19 are provided at elevations of concrete carriers or at special sliding ledges made of steel or concrete that are connected by composite structures or by welding, bolting, or otherwise with other structural members to become finished guideway carriers, or simply consist of basically even surfaces of concrete, composite or steel carriers. Moreover, it is self-evident that systems of the company Hempel that have been mentioned as examples can be wholly or partly replaced with corresponding systems from other companies, and that thickness rates other than those described hereinabove can be chosen for the various layers, and that other portions of the additional material can be applied in layers 16, 17, and/or 22, 23. For example, as an alternative for use as matrix material for the outer layers 17, 23 it would also be possible to use a material based on an epoxy or acrylate resin. Furthermore, it is convenient to produce said sliding surfaces 14, 19 each with some undersize to obtain after coating the demanded tongs size between coating surface and the undersides of stator packs 3. Alternately, the increase in the tongs size caused by the coating could also be offset by a corresponding change to sliding skates 8. Finally, it is self-evident that the various features can also be applied in combinations other than those illustrated and described hereinabove.

The invention claimed is:

1. A guideway with a sliding surface (14, 19) for a magnetically levitated vehicle (4) having at least one sliding skid (8) for being set-down onto said sliding surface (14, 19) during a standstill and in case of emergency during travel of the vehicle (4), wherein said sliding surface (14, 19) is provided with a coating (15-17; 21-23) comprising at least in an outer area a mixture of a ground or matrix material and an additional material, said additional material being a tribulogically active material having low friction and wear relative to a sliding skid material of said sliding ski (8), such that an immediate braking of the vehicle (4) is avoided when the sliding skid (8) is set down onto said sliding surface (14, 19) during travel of the vehicle.

2. A guideway according to claim 1, wherein said additional material contains graphite and/or polytetrafluorethylene.

3. A guideway according to claim 1, wherein said coating is configured in several layers and has at least one outer layer (17, 23) comprised of polyurethane, epoxy, or acrylate resin modified with said additional material.

4. A guideway according to claim 3, wherein the outer layer (17, 23) is comprised of 30% by wt. to 50% by wt. of graphite as additional material.

5. A guideway according to claim 3, wherein the outer layer (17, 23) is comprised of 10% by wt. to 40% by wt. of polytetrafluorethylene as additional material.

6. A guideway according to claim 3, wherein said coating is comprised of a second layer (16, 22) located beneath said outer layer (17, 23) and acting as adaptor aver and made of epoxy resin modified with said additional material.

7. A guideway according to claim 6, wherein the second layer (16, 22) is comprised of 10% by wt. to 30% by wt. of graphite as additional material.

8. A guideway according to claim 6, wherein the second layer (16, 22) is comprised of 10% by wt. to 40% by wt. of polytetrafluorethylene as additional material.

9. A guideway according to claim 3, wherein said coating is comprised of a third epoxy-based inner layer (15, 21) immediately applied onto said sliding surface (14, 19) and configured as wash primer.

10. A guideway according to claim 9, wherein said sliding surface (19) is made of steel and that the third layer (23) is configured as anti-rust wash primer.

11. A guideway according to claim 1, wherein said coating has a maximum film thickness of 1 mm in total.

12. A magnetic levitation railway with a guideway provided with a sliding surface (14, 19) and having at least one magnetically levitated vehicle (4) having at least one sliding skid (8) for being set-down onto said sliding surface (14, 19) during a standstill condition of said vehicle (4) and in case of an emergency during travel of the vehicle (4), said sliding skid (8) being made of a carbon fiber-reinforced carbon enriched with SiC, wherein said sliding surface (14, 19) is provided with a coating (15-17; 21-23) which comprises at least in an outer area a mixture of a ground or matrix material and an additional material, said additional material being a tribulogically active material having low friction and wear relative to said sliding skid material, such that an immediate braking of the vehicle (4) is avoided when the sliding ski (8) is set down onto said sliding surface (14, 19) during travel of the vehicle (4).

13. A magnetic levitation railway according to claim 12, wherein said additional material contains graphite and/or polytetrafluorethylene.

14. A magnetic levitation railway according to claim 12, wherein said coating is configured in several layers and has at least one outer layer (17, 23) comprised of polyurethane, epoxy, or acrylate resin modified with said additional material.

15. A magnetic levitation railway according to claim 14, wherein the outer layer (17, 23) is comprised of 30% by wt. to 50% by wt. of graphite as additional material.

16. A magnetic levitation railway according to claim 14, wherein the outer layer (17, 23) is comprised of 10% by wt. to 40% by wt. of polytetrafluorethylene as additional material.

17. A magnetic levitation railway according to claim 14, wherein said coating is comprised of a second layer (16, 22) located beneath said outer layer (17, 23) and acting as adaptor layer and made of epoxy resin modified with said additional material.

18. A magnetic levitation railway according to claim 17, wherein the second layer (16, 22) is comprised of 10% by wt. to 30% by wt. of graphite as additional material.

19. A magnetic levitation railway according to claim 17, wherein the second layer (16, 22) is comprised of 10% by wt. to 40% by wt. of polytetrafluorethylene as additional material.

20. A magnetic levitation railway according to claim 14, wherein said coating is comprised of a third epoxy-based inner layer (15, 21) immediately applied onto said sliding surface (14, 19) and configured as wash primer.

21. A magnetic levitation railway according to claim 20, wherein said sliding surface (19) is made of steel and that the third layer (23) is configured as anti-rust wash primer.

22. A magnetic levitation railway according to claim 12, wherein said coating has a maximum film thickness of 1 mm in total.

* * * * *